US010065793B2

(12) United States Patent
Guo et al.

(10) Patent No.: US 10,065,793 B2
(45) Date of Patent: Sep. 4, 2018

(54) PACKAGING STRUCTURE AND PACKAGING METHOD FOR DISPLAY PANEL

(71) Applicants: BOE TECHNOLOGY GROUP CO., LTD., Beijing (CN); BEIJING BOE DISPLAY TECHNOLOGY CO., LTD., Beijing (CN)

(72) Inventors: Junjie Guo, Beijing (CN); Sangjig Lee, Beijing (CN); Dan Wang, Beijing (CN); Seung Min Lee, Beijing (CN); Hongyu Zhao, Beijing (CN); Yutao Hao, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 458 days.

(21) Appl. No.: 14/409,158

(22) PCT Filed: Jul. 3, 2014

(86) PCT No.: PCT/CN2014/081576
§ 371 (c)(1),
(2) Date: Dec. 18, 2014

(87) PCT Pub. No.: WO2015/096447
PCT Pub. Date: Jul. 2, 2015

(65) Prior Publication Data

US 2016/0272412 A1 Sep. 22, 2016

(30) Foreign Application Priority Data

Dec. 24, 2013 (CN) ..... 2013 1 0722909

(51) Int. Cl.
*B65D 85/48* (2006.01)
*B65B 5/04* (2006.01)
(Continued)

(52) U.S. Cl.
CPC ..... *B65D 85/48* (2013.01); *B65B 5/04* (2013.01); *B65D 25/04* (2013.01); *B65D 85/30* (2013.01)

(58) Field of Classification Search
None
See application file for complete search history.

(56) References Cited

U.S. PATENT DOCUMENTS 2,985,333 A * 5/1961 Kirkman ..... A47B 88/90 220/533
4,436,215 A * 3/1984 Kleinert ..... B65D 25/06 220/533
(Continued)

FOREIGN PATENT DOCUMENTS

CN 1923632 A 3/2007
CN 201703721 U 1/2011
(Continued)

OTHER PUBLICATIONS

International Preliminary Report on Patentabiiity dated Jun. 28, 2016; PCT/CN2014/081576.
(Continued)

*Primary Examiner* — Hemant M Desai
*Assistant Examiner* — Tanzim Imam
(74) *Attorney, Agent, or Firm* — Ladas & Parry LLP

(57) ABSTRACT

A packaging structure and a packing method for a display panel are provided, the display panel includes a display panel body (201) and a circuit board (202), and the packaging structure of the display panel includes: a box body (301) including an inner chamber and an opening at an upper
(Continued)

surface of the box body (301); and at least one support division plate (302) provided in the inner chamber of the box body. The support division plate (302) is configured to be perpendicular to the upper surface of the box body (301) and to divide the inner chamber of the box body (301) into a plurality of vertical placement spaces, so that each of the placement spaces is configured for the display panel (20) to be vertically placed therein with a display surface of the display panel body (201) placed in the placement space being perpendicular to the upper surface (w) of the box body. The packaging structure of the display panel can increase the number of placed display panels (20), and decrease the damage to the display panels (20).

17 Claims, 6 Drawing Sheets

(51) Int. Cl.
*B65D 25/04* (2006.01)
*B65D 85/30* (2006.01)

(56) References Cited

U.S. PATENT DOCUMENTS 4,798,305 A * 1/1989 Laverty ..... B65D 25/06 206/718
5,103,998 A * 4/1992 Caro ..... B65D 25/06 220/531
5,474,178 A * 12/1995 DiViesti ..... H01R 43/00 206/564
6,457,323 B1 * 10/2002 Marotta ..... B65D 25/06 62/371
2002/0159240 A1 * 10/2002 Watanabe ..... B65D 5/509 361/752
2004/0188303 A1 * 9/2004 Chouinard ..... B65D 85/48 206/456
2005/0173294 A1 * 8/2005 Chen ..... B65D 5/48046 206/593
2005/0194279 A1 * 9/2005 Coppola ..... B65D 85/48 206/454
2006/0226047 A1 * 10/2006 Takagi ..... B65D 85/48 206/725
2007/0053146 A1 3/2007 Lee et al.
2007/0054524 A1 * 3/2007 Lee ..... B65D 81/053 439/157
2007/0077847 A1 * 4/2007 Hirata ..... B65D 81/113 445/24
2008/0110795 A1 * 5/2008 Kao ..... B65D 85/48 206/710
2010/0075097 A1 * 3/2010 Wang ..... B65D 81/053 428/59
2013/0255189 A1 * 10/2013 Zhao ..... B65D 81/05 53/410
2014/0332422 A1 11/2014 Hu

FOREIGN PATENT DOCUMENTS

CN 201721775 U * 1/2011
CN 102616463 A * 8/2012 ..... B65D 81/05
CN 202609238 U 12/2012
CN 103241469 A 8/2013
CN 203173159 U 9/2013
CN 103708127 A 4/2014
JP 1035774 A 2/1998
WO 2006/101289 A1 9/2006
WO WO 2006101289 A1 * 9/2006 ..... B65D 25/103

OTHER PUBLICATIONS

International Search Report dated Sep. 22, 2014; PCT/CN2014/081576.
First Chinese Office Action dated Jun. 1, 2015; Appln. No. 201310722909.3.

* cited by examiner

PACKAGING STRUCTURE AND PACKAGING METHOD FOR DISPLAY PANEL

TECHNICAL FIELD

At least one embodiment of the present disclosure relates to a packaging structure and a packing method for a display panel.

BACKGROUND

The glass material for a liquid crystal display panel is an article with poor crashworthiness, and is likely to be broken up when subjected to impact or shock, and this causes the discard of the whole display panel. Most of the packaging structures of display panels are obtained by directly using a foam packing material. When packaged, display panels are usually placed into a box body horizontally and stacked one layer above the other. However, due to the gravity of a display panel itself, the number of the display panels stacked in one display-panel packaging structure cannot be too large, so a smaller number of display panels are placed, and the display panels are easily to be damaged.

SUMMARY

At least one embodiment of the present disclosure provides a packaging structure and a packing method for a display panel, which can increase the number of the placed display panels and decrease the damage to the display panels.

At least one embodiment of the present disclosure provides a packaging structure for a display panel, the display panel includes a display panel body and a circuit board, and the packaging structure includes: a box body including an inner chamber and an opening which is provided at an upper surface of the box body; and at least one support division plate located in the inner chamber of the box body. The support division plate is configured to be perpendicular to the upper surface of the box body and to divide the inner chamber of the box body into a plurality of vertical placement spaces, so that each of the placement spaces is configured for the display panel to be vertically placed therein with a display surface of the display panel body placed in the placement space being perpendicular to the upper surface of the box body.

At least one embodiment of the present disclosure provides a packaging method for a display panel, the display panel includes a display panel body and a circuit board, and the method includes: placing the display panel body into a placement space so as to make a display surface of the display panel body placed in the placement space perpendicular to an upper surface of the box body; and fixing the circuit board with a circuit board fixing portion.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative of the disclosure.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Figure 1:
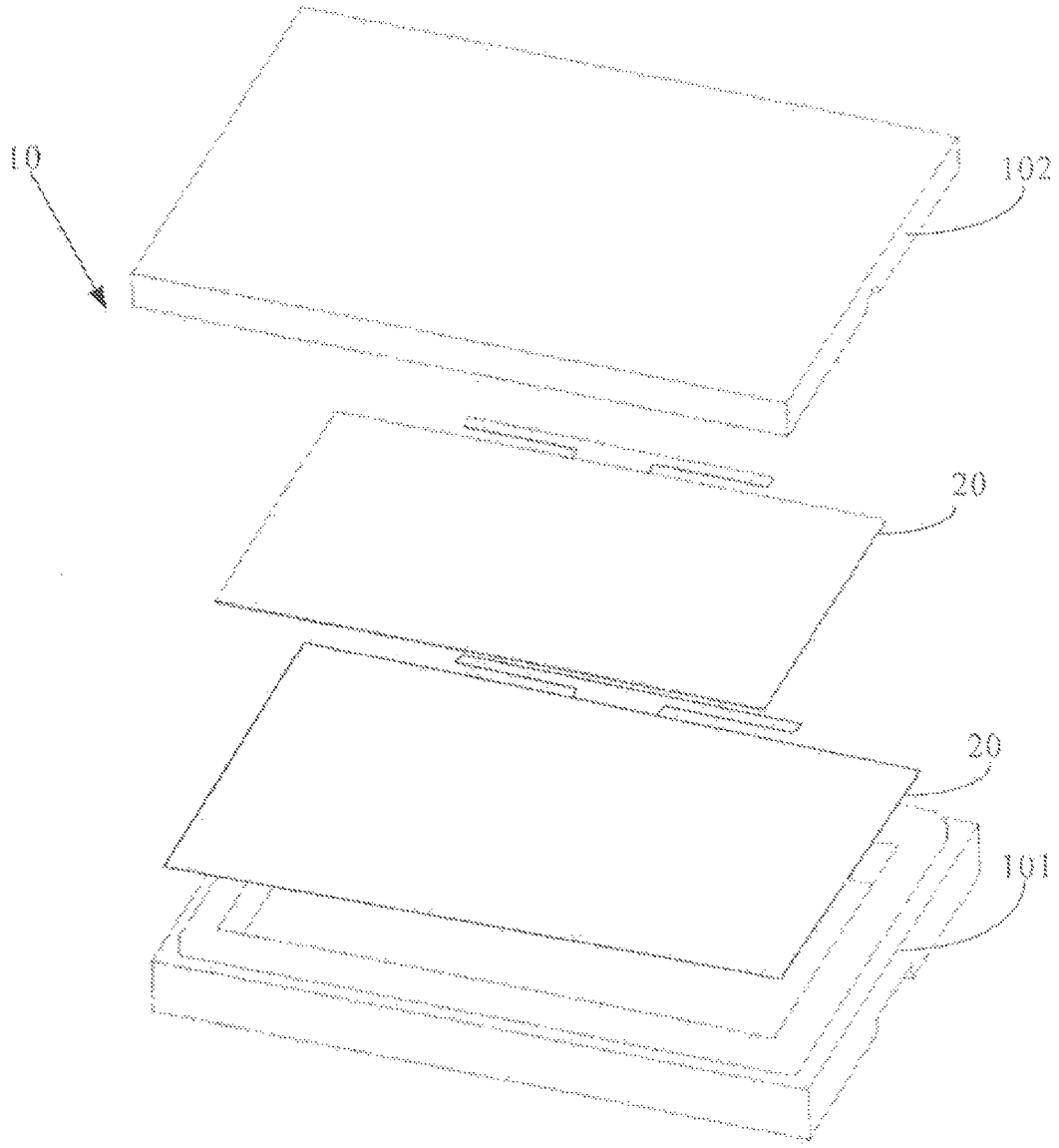
Fig. 1 (Prior Art)
FIG. 1 is a schematic view showing a packaging structure for a display panel.

A packaging structure 10 for a display panel, as shown in FIG. 1, includes: a box body 101 with an opening at an upper surface thereof; and a box cover 102 which may be placed onto the upper surface of the box body 101 so as to cover the opening and close the box body 101. Display panels 20 are stacked in the inner chamber of the box body 101 by layers. However, due to the gravity of the display panel 20 itself, the layer number of the display panels stacked in the display-panel packaging structure 10 cannot be too large, otherwise the display panels 20 can be damaged.

Figure 2:
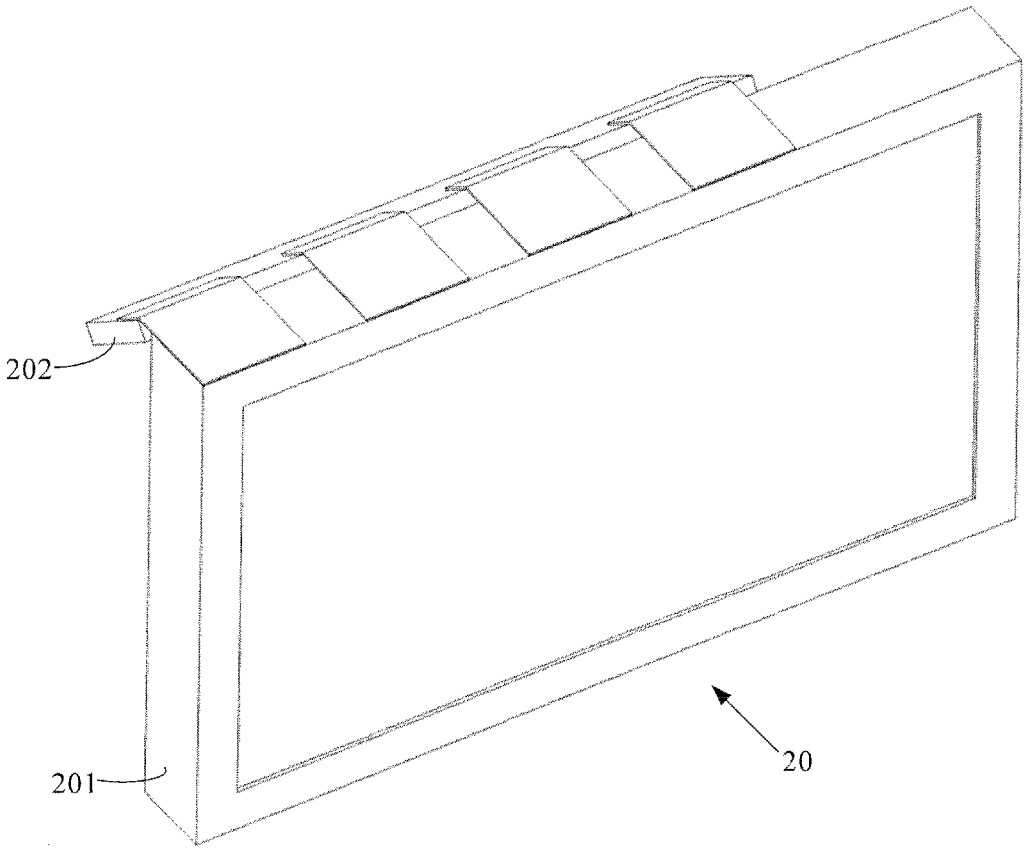
FIG. 2 is a structural schematic view of a display panel according to an embodiment of the present disclosure.

For example, the structure for a display panel 20 may, as shown in FIG. 2, includes a display panel body 201 and a circuit board 202, and the display panel body 201 and the circuit board 202 may be adhesively coupled through a connector, such as a chip on flex or a chip on film (COF). Embodiments of present disclosure do not restrict the connecting mode between the display panel body 201 and the circuit board 202.

Figure 3:
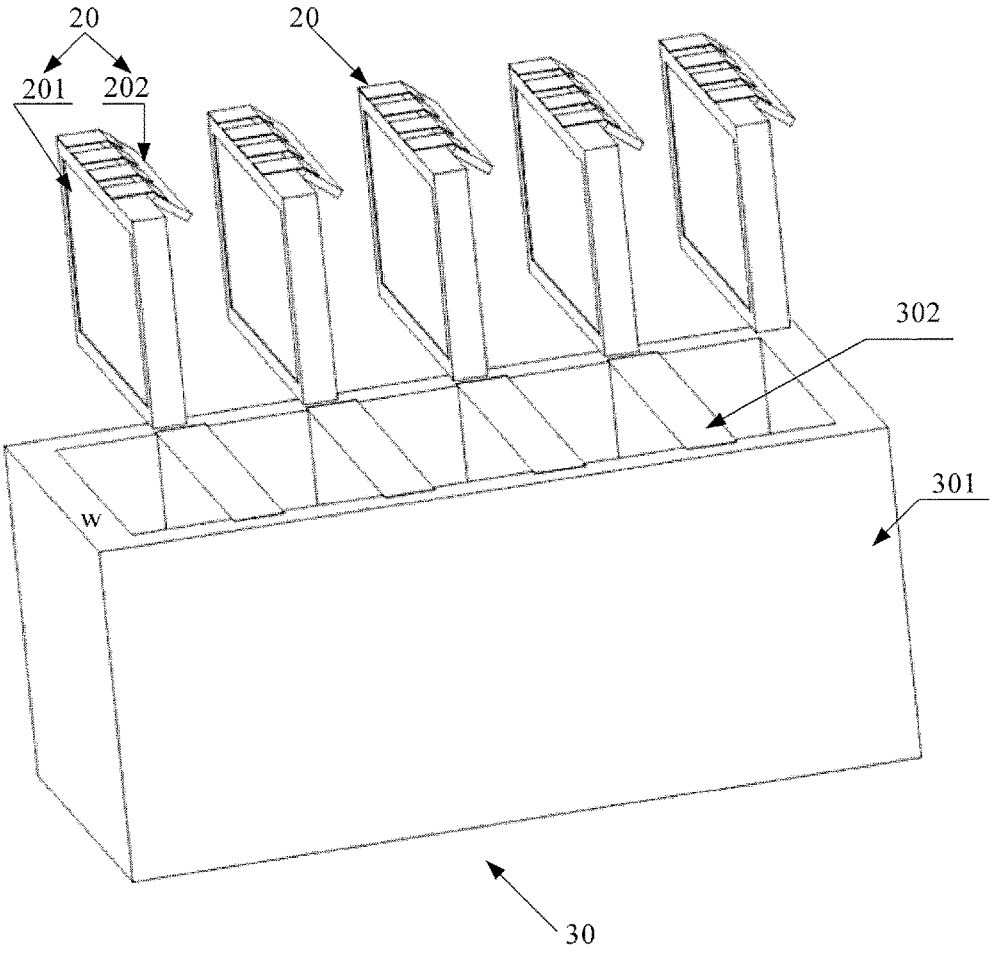
FIG. 3 is schematic view of a packaging structure for a display panel, according to an embodiment of the present disclosure.

At least one embodiment of the present disclosure provides a packaging structure 30 for a display panel, as shown in FIG. 3, the packaging structure 30 for a display panel includes a box body 301, the box body 301 includes an inner chamber, and the upper surface of the box body 301 is open. In at least one embodiment of the present disclosure, when the box body 301 is properly placed, two of outer surfaces of the box body 301 are parallel to the plane where the box body 301 is located, and are an upper surface and a bottom surface respectively, and the upper surface is a face that does not contact with the plane where the box body 301 is located. The upper surface may be the plane w in FIG. 3. The box body 301 may be made from an expanded material.

The inner chamber of the box body 301 includes four sidewalls, and at least one support division plate 302 is provided in the inner chamber. The four sidewalls form a rectangle or a square, for example. The support division plate 302 is perpendicular to the upper surface w of the box body and divides the inner chamber of the box body into a plurality of vertical placement spaces, so that each of the placement spaces is configured for the display panel to be vertically placed therein with a display surface of the display panel body 201 placed in the placement space being perpendicular to the upper surface w of the box body. The vertical placement space has a thickness smaller than its length and height and corresponds to the display panel body to be placed therein in shape and dimension.

For example, when there are at least two support division plates, the support division plates are arranged linearly and spaced from each other, and the spacing between the support division plates is greater than or equal to the thickness of the display panel. After the placement of the display panel 20, respective placement spaces may be further filled with an expanded material, such as expandable polyolefin (EPO), expanded polypropylene (EPP) and expandable polypropylene (EPS), so as to decrease the damage to the display panel, caused by the impact between the display panel and the support division plate.

At least one support division plate is placed in the inner chamber of the box body so as to divide the inner chamber of the box body into a plurality of placement spaces, so a plurality of display panels may be placed vertically in one box body. At the same time, individual display panels placed in the placement spaces can not press other display panels due to its gravity, so it's possible to increase the number of the placed display panels and decrease the damage to the display panels.

It is to be noted that the display panel includes a display panel body and a circuit board, and the display panel body is in movable connection with the circuit board; since the display panel body is perpendicular to the upper surface of the box body and placed in the inner chamber of the box body, when sway occurs during the transportation and the circuit board is not effectively fixed, it's possible for the display panel body to be beat or rubbed, and this causes the display panel body to be damaged. Hence, in at least one embodiment, each of the placement spaces of the box body may be provided with a circuit board fixing portion.

Figure 4:
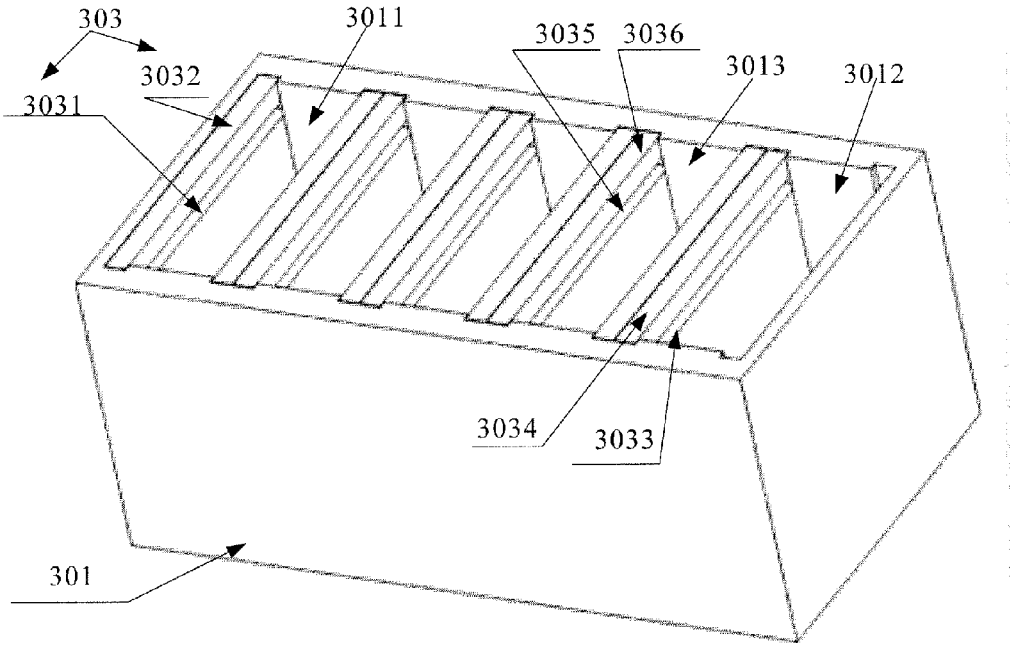
FIG. 4 is a schematic view of a packaging structure for a display panel, according to another embodiment of the present disclosure.

As shown in FIG. 4, when the placement space is enclosed with one support division plate and the inner chamber wall of the box body, for example, the first placement space 3011, the circuit board fixing portion 303 includes a groove 3031 located in the inner chamber wall of the box body 301 and a circuit board pressing block 3032 configured to be movable, and the circuit board pressing block 3032 can be inserted into the groove 3031, and press and secure the circuit board (not shown in FIG. 4) placed into the groove 3031. For example, when the placement space is enclosed with one support division plate and the inner chamber wall of the box body, such as the second placement space 3012, the circuit board fixing portion 303 may also include a groove 3033 located in one support division plate and a circuit board pressing block 3034 configured to be movable, the circuit board pressing block 3034 may be inserted into the groove 3033, and press and secure the circuit board (not shown in FIG. 4) placed into the groove 3033. The groove 3033 may be located at the upper part of the inner chamber wall of the box body, to which wall the division plate is opposite, and the height from the bottom surface of the groove 3033 to the bottom surface of the box body may be equal to the height of the display panel (not shown in FIG. 4).

When the placement space is enclosed with two support division plates and the inner chamber wall of the box body, such as the third placement space 3013, the circuit board fixing portion includes a groove 3035 located in one of the two support division plates and a circuit board pressing block 3036 configured to be movable, and the circuit board pressing block 3036 may be inserted into the groove 3035 and press and secure the circuit board (not shown in FIG. 4) placed into the groove 3035. The groove 3035 is located at the upper part of the support division plate, and the height from the bottom surface of the groove 3035 to the bottom surface of the box body may be equal to the height of the display panel (not shown in FIG. 4). For example, the circuit board pressing block may be made from an anti-electrostatic material, such as EPO, EPP or an engineering plastic, and this can reduce the static electricity caused by friction during the placement of the circuit boards.

Figure 5:
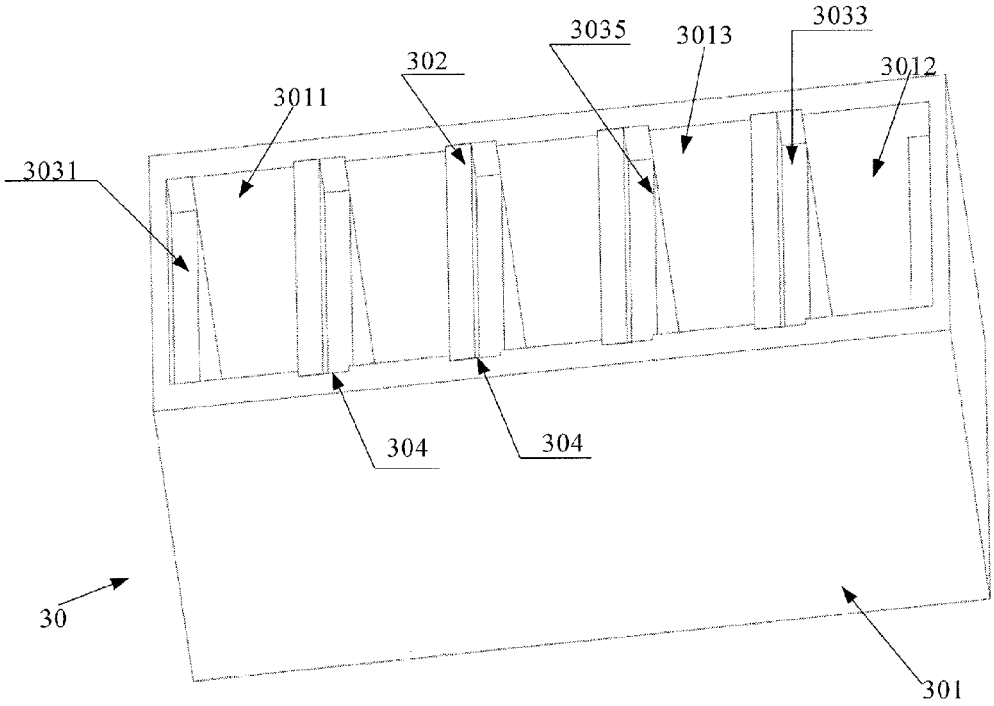
FIG. 5 is a schematic view of a packaging structure for a display panel, according to a further embodiment of the present disclosure.

When respective circuit board pressing blocks are taken out from the packaging structure 30 for a display panel, the packaging structure 30 for a display panel is shown in FIG. 5 which illustrates the groove 3031 located in the inner chamber wall of the box body 301 in the first placement space 3011, the groove 3033 located in the one support division plate in the second placement space 3012, and the groove 3035 located in one of the two support division plates in the third placement space 3013. As shown in FIG. 5, the packaging structure 30 for a display panel may further include a slot 304 formed in the sidewall of the box body, the number of the slots 304 is equal to the number of the support division plates 302, and the support division plate 302 is in movable connection with the box body 301 by being inserted into the slot 304. For example, as shown in FIG. 5, four support division plates are provided, and then there are totally four slots 304.

It is to be noted that in the packaging structure for a display panel, according to an embodiment, at least one support division plate may be provided to be integrally formed with the box body. In practical application, all of the support division plates may be integrated with the box body, in which case, the support division plate is in fixed connection with the box body without the need of disassembly and assembly.

Figure 6:
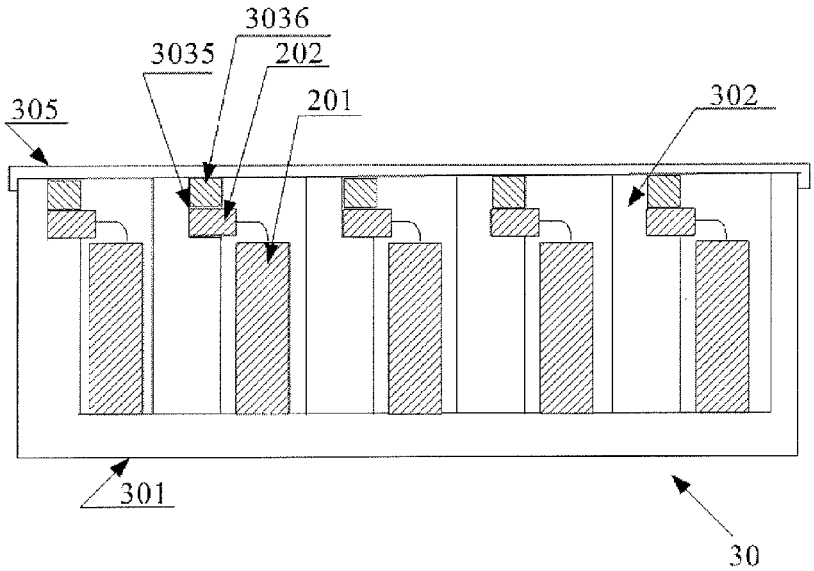
FIG. 6 is a schematic sectional view of a packaging structure for a display panel, according to an embodiment of present disclosure.

In at least one embodiment of the present disclosure, the packaging structure 30 for a display panel may further include a box cover 305, as shown in FIG. 6. FIG. 6 is a schematic sectional view of the packaging structure 30 for a display panel. The box cover 305 covers the upper surface of the box body 301 and used for closing the box body, and this can prevent foreign matters, such as dust, from falling into the box body during transportation, to reduce contamination of and damage to the display panels. The support division plates 302 divide the inner chamber of the box body into a plurality of placement spaces so that each of the placement spaces permits the vertical placement of the display panel 20, the display panel 20 includes a display panel body 201 and a circuit board 202, and for example, the circuit board pressing block 3036 is inserted into the groove 3035 and press and secure the circuit board 202 placed into the groove 3035.

For the convenience of description, the first display panel is taken as an example in an embodiment of the present disclosure. In this embodiment of the present disclosure, when the first display panel is to be packaged using the packaging structure for a display panel, the display panel body of the first display panel may be placed vertically into the placement space of the box body so that the display surface of the display panel body placed in the placement space is perpendicular to the upper surface of the box body; then, the circuit board of the first display panel is secured using the circuit board fixing portion. For example, when the placement space where the first display panel is located is enclosed with one support division plate and the inner chamber wall of the box body, and the inner chamber wall of the box body is provided with a groove therein, the circuit board may be inserted into the groove in the inner chamber wall of the box body, and the circuit board pressing block may be inserted into the groove and press and secure the circuit board placed in the groove. When the placement space in which the first display panel is placed is enclosed with one support division plate and the inner chamber wall of the box body, and a groove is formed in the support division plate, the circuit board may be inserted into the groove in the support division plate, and the circuit board pressing block may be inserted into the groove and press and secure the circuit board placed in the groove. When the placement space is enclosed with two support division plates and the inner chamber wall of the box body, and a groove is formed in one of the two support division plates, the circuit board may be inserted into the groove formed in one of the support division plates, and the circuit board pressing block may be inserted into the groove and press and secure the circuit board placed in the groove. After the placement of the display panel, each of the individual placement spaces may be further filled with EPO, EPP and EPS and similar expanded materials, so as to decrease the damage to the display panel, caused by the impact between the display panel and the support division plate.

It is to be noted that the placing method of other display panels is identical to that of the first display panel, and repeated description thereof is omitted herein, and finally, when all of the display panels are placed into the box body, the box cover may be arranged onto the upper surface of the box body so as to close the box body.

In the packaging structure for a display panel, provided by at least one embodiment of the present disclosure, at least one support division plate is provided in the inner chamber of the box body so as to divide the inner chamber of the box body into a plurality of placement spaces, so that a plurality of display panels can be placed vertically; and at the same time, individual display panels placed in the placement spaces cannot press other display panels due to its gravity. Therefore, the number of placed display panels can be increased and the damage to the display panels can be reduced.

Figure 7:
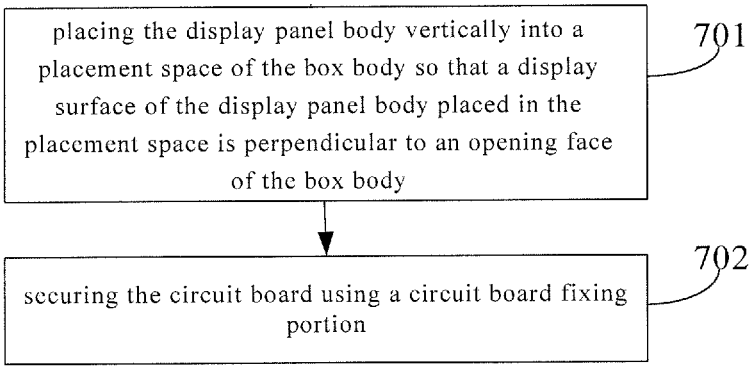
FIG. 7 is a flow chart illustrating a packaging method for a display panel, according to an embodiment of present disclosure.

An embodiment of present disclosure provides a packaging method for a display panel, the display panel includes a display panel body and a circuit board, and as shown in FIG. 7, the method includes the following steps.

Step 701, placing the display panel body vertically into a placement space of the box body, so that a display surface of the display panel body placed in the placement space is perpendicular to an upper surface of the box body.

Step 702, securing the circuit board using a circuit board fixing portion.

For example, the circuit board may be inserted into a groove formed in an inner chamber wall of the box body or in the support division plate; and the circuit board pressing block is inserted into the groove and presses and secures the circuit board placed in the groove.

In particular, when the placement space in which the first display panel is placed is enclosed with one support division plate and the inner chamber wall of the box body, and a groove is formed in the inner chamber wall of the box body, the circuit board may be inserted into the groove in the inner chamber wall of the box body, and the circuit board pressing block may be inserted into the groove and press and secure the circuit board placed in the groove. When the placement space in which the first display panel is placed is enclosed with one support division plate and the inner chamber wall of the box body, and a groove is formed in the support division plate, the circuit board may be inserted into the groove in the support division plate, and the circuit board pressing block may be inserted into the groove and press and secure the circuit board placed in the groove. When the placement space is enclosed with two support division plates and the inner chamber wall of the box body, and a groove is formed in one of the two support division plates, the circuit board may be inserted into the groove formed in one of the support division plates, and the circuit board pressing block may be inserted into the groove and press and secure the circuit board placed in the groove.

In this way, because the display panel is placed vertically in the placement space of the box body, the display panel is unlikely to press other display panels due to its own gravity. Thus the number of placed display panels is increased and the damage to the display panels is reduced.

It can be clearly understood to the skilled in this art that, for the convenience and simplicity of the description, the specific steps of the above-mentioned method can be referred to corresponding processes in preceding embodiments of the packaging structure for a display panel, and will not be repeated herein.

What are described above is related to the illustrative embodiments of the disclosure only and not limitative to the scope of the disclosure; the scopes of the disclosure are defined by the accompanying claims.

The present application claims the priority of the Chinese Patent Application No. 201310722909.3 filed on Dec. 24, 2013, the entirety of which is incorporated herein by reference as a part of the present application.

What is claimed is:

1. A packaging structure for a display panel, wherein the display panel comprises a display panel body and a circuit board, and the packaging structure comprises:

a box body comprising an inner chamber and an opening which is provided at an upper surface of the box body; and at least one support division plate provided in the inner chamber of the box body, wherein the at least one support division plate is configured to be perpendicular to the upper surface of the box body and to divide the inner chamber of the box body into a plurality of vertical placement spaces so that each of the plurality of vertical placement spaces is configured for the display panel to be vertically placed therein with a display surface of the display panel body placed in the placement space being perpendicular to the upper surface of the box body, wherein each placement space of a first subset of the plurality of vertical placement spaces is provided with a circuit board fixing portion configured for fixing the circuit board, the circuit board fixing portion comprising a groove formed on the at least one support division plate, a size of the groove along a direction from a first to a second of the plurality of vertical placement spaces being smaller than a thickness of a portion of the at least one support division plate other than the groove, and the thickness being a size of the portion of the at least one support division plate other than the groove along the direction from the first to the second of the plurality of vertical placement spaces.

2. The packaging structure for a display panel according to claim 1, wherein each placement space of a second subset of the plurality of vertical placement spaces is enclosed by one support division plate and an inner chamber wall of the box body, each placement s ace of the second subset of the plurality of vertical placement spaces is provided with a circuit board fixing portion configured for fixing the circuit board, and the circuit board fixing portion of each placement space of the second subset of the plurality of vertical placement spaces comprises:

a groove in the inner chamber wall of the box body, and a circuit board pressing block configured to be movable, wherein the circuit board pressing block is configured to be inserted into the groove in the inner chamber wall and press and fix the circuit board when the circuit board is placed in the groove in the inner chamber wall.

3. The packaging structure for a display panel according to claim 2, wherein the groove in the inner chamber wall is located at an upper part of the inner chamber wall of the box body, to which wall the at least one support division plate is opposite, and a height from a bottom surface of the groove in the inner chamber wall to a bottom surface of the box body is equal to a height of the display panel.

4. The packaging structure for a display panel according to claim 1, wherein each placement space of the first subset of the plurality of vertical placement spaces is enclosed by two support division plates and an inner chamber wall of the box body, and the circuit board fixing portion further comprises:

a circuit board pressing block configured to be movable, wherein the circuit board pressing block is configured to be inserted into the groove and press and fix the circuit board when the circuit board is placed in the groove.

5. The packaging structure for a display panel according to claim 4, wherein the groove is located at an upper part of the support division plate, and a height from a bottom surface of the groove to a bottom surface of the box body is equal to a height of the display panel.

6. The packaging structure for a display panel according to claim 1, further comprising:

at least one slot located in a side wall of the box body, wherein a quantity of the at least one slot is equal to a quantity of the at least one support division plate; and the at least one support division plate is configured to be in movable connection with the box body by being inserted into the at least one slot.

7. The packaging structure for a display panel according to claim 1, wherein the at least one support division plate and the box body are configured to be an integrated part.

8. The packaging structure for a display panel according to claim 2, wherein the circuit board pressing block is made from an anti-electrostatic material.

9. The packaging structure for a display panel according to claim 1, wherein the at least one support division plate comprises at least two support division plates, the at least two support division plates are arranged linearly and spaced from each other, and a spacing between the at least two support division plates is greater than or equal to a thickness of the display panel.

10. The packaging structure for a display panel according to claim 1, wherein the box body is made from an expanded material.

11. The packaging structure for a display panel according to claim 1, further comprising:

a box cover placed onto the upper surface of the box body and configured for closing the box body.

12. The packaging structure for a display panel according to claim 2, further comprising:

at least one slot located in a side wall of the box body, wherein a quantity of the at least one slot is equal to a quantity of the at least one support division plate; and the at least one support division plate is configured to be in movable connection with the box body by being inserted into the at least one slot.

13. The packaging structure for a display panel according to claim 3, further comprising:

at least one slot located in a side wall of the box body, wherein a quantity of the at least one slot is equal to a quantity of the at least one support division plate; and the at least one support division plate is configured to be in movable connection with the box body by being inserted into the at least one slot.

14. The packaging structure for a display panel according to claim 4, further comprising:

at least one slot located in a side wall of the box body, wherein a quantity of the at least one slot is equal to a quantity of the at least one support division plate; and the at least one support division plate is configured to be in movable connection with the box body by being inserted into the at least one slot.

15. The packaging structure for a display panel according to claim 5, further comprising:

at least one slot located in a side wall of the box body, wherein a quantity of the at least one slot is equal to a quantity of the at least one support division plate; and the at least one support division plate is configured to be in movable connection with the box body by being inserted into the at least one slot.

16. The packaging structure for a display panel according to claim 1, wherein the at least one support division plate and the box body are configured to be an integrated part.

17. A packaging method for a display panel, wherein the display panel comprises a display panel body and a circuit board, and the packaging method comprises:

placing the display panel body into a placement space of a box body vertically, in such a way that a display surface of the display panel body placed into the placement space is perpendicular to an upper surface of the box body; and fixing the circuit board through a circuit board fixing portion, wherein the circuit board is inserted into a groove in an inner chamber wall of the box body or in a support division plate, a circuit board pressing block is inserted into the groove, and the circuit board inserted into the groove is pressed and fixed.

* * * * *